United States Patent [19]

Perfect

[11] Patent Number: 4,616,435

[45] Date of Patent: Oct. 14, 1986

[54] IDENTIFICATION CARD HOLDER

[75] Inventor: Alan J. Perfect, Crosswicks, N.J.

[73] Assignee: LaFrance Corporation, Philadelphia, Pa.

[21] Appl. No.: 599,059

[22] Filed: Apr. 11, 1984

[51] Int. Cl.[4] ..... G09F 3/20

[52] U.S. Cl. ..... 40/6; 40/21 R; 40/10 R

[58] Field of Search ..... 40/10 R, 17, 16, 21 R, 40/158 B, 6

[56] References Cited

U.S. PATENT DOCUMENTS 1,618,073 2/1927 Flint ..... 40/10 R
2,655,747 10/1953 Duskin ..... 40/21 R
3,961,431 6/1976 Kalenian ..... 40/21 R
4,450,955 5/1984 Featherston ..... 40/16

FOREIGN PATENT DOCUMENTS 795492 5/1958 United Kingdom ..... 40/21 C

*Primary Examiner*—Robert Peshock
*Assistant Examiner*—Cary E. Stone
*Attorney, Agent, or Firm*—Connolly and Hutz

[57] ABSTRACT

An identification card holder is formed from a one-piece molded body which has a flat base and a three-sided frame above the base with the fourth side being open to create a slot. An identification card is inserted in the slot and a transparent shield is then inserted above the card to protect the card and hold it in place.

3 Claims, 8 Drawing Figures

IDENTIFICATION CARD HOLDER

BACKGROUND OF INVENTION

Identification card holders are conventionally used in connection, for example, with identification tags or the like which are secured to suitcases, briefcases and various forms of luggage. In general the card holders are formed by providing a four-sided frame above a base and inserting an identification card into the frame. The card holder is then secured to the luggage or the like by a strap, chain or other means. Various materials have been used for such card holders, particularly metal and leather. It would be desirable, however, if such card holders could be produced in mass quantity from plastic materials such as by injection molding.

SUMMARY OF INVENTION

An object of this invention is to provide an identification card holder which is made by injection molding.

A further object of this invention is to provide such an identification card holder wherein some degree of flexibility is provided in the size of card held therein without detracting from the effectiveness of the card holder.

In accordance with this invention, the identification card holder includes a one-piece molded body member having a three-sided frame integrally connected and extending above a flat base. The fourth side of the frame is open with a slot created thereby so that a card may be inserted into the frame against the base. A transparent shield is then inserted into the frame above the card to protect the card and maintain it in place.

The base may include a slot adjacent the open face of the frame so that a securing strap may be inserted through the slot to not only secure the card holder to an article of luggage or the like but also to prevent the card and shield from sliding out of the frame.

The frame may include guide surfaces to facilitate inserting the sheild into the frame and may be dimensioned to tightly hold the shield in place. Additionally, a three-sided ledge may be formed on the base parallel with and conforming to the frame so that the card may be positioned in the open space created by the ledge while the shield may be disposed on the ledge.

THE DRAWINGS

Figure 1:
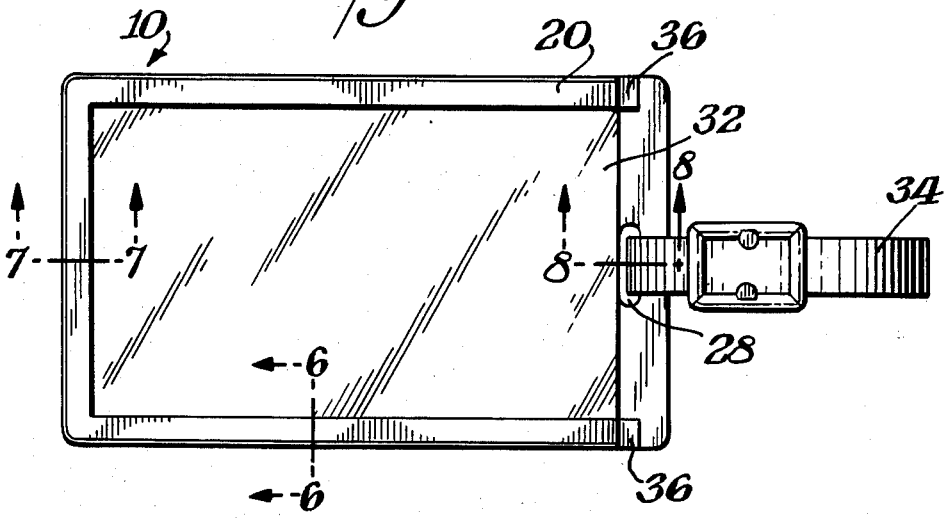
FIG. 1 is a top plan view of an identification card holder in accordance with this invention.
Figure 2:
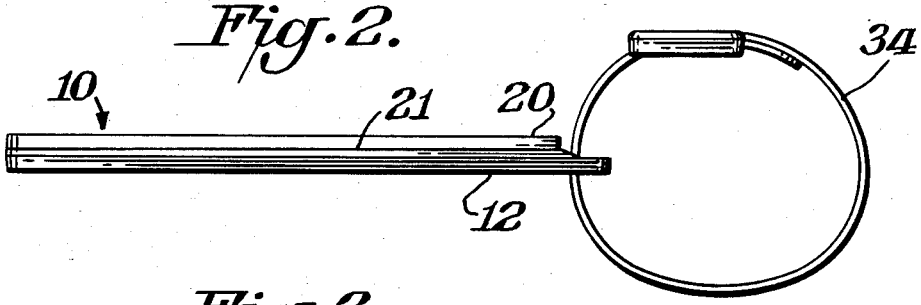
FIG. 2 is a side view in elevation of the identification card holder shown in FIG. 1.
Figure 3:
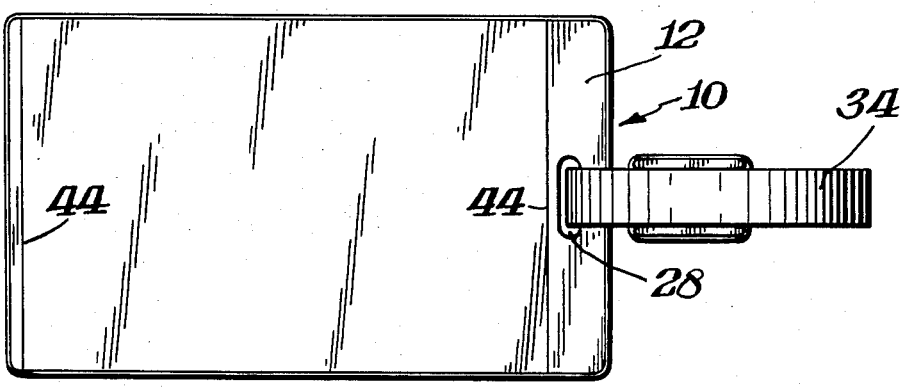
FIG. 3 is a bottom plan view of the identification card holder of FIGS. 1–2.
Figure 4:
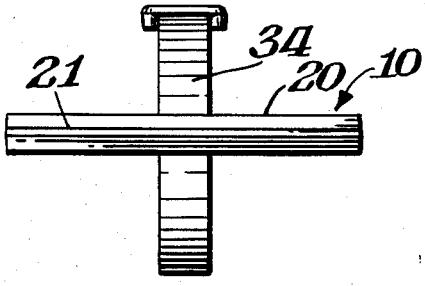
Figure 5:
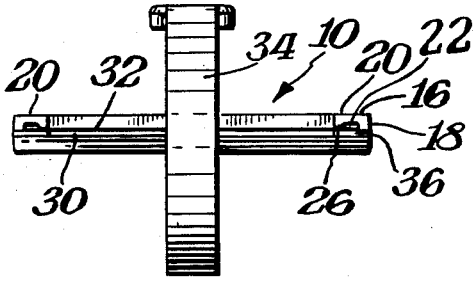
Figure 6:
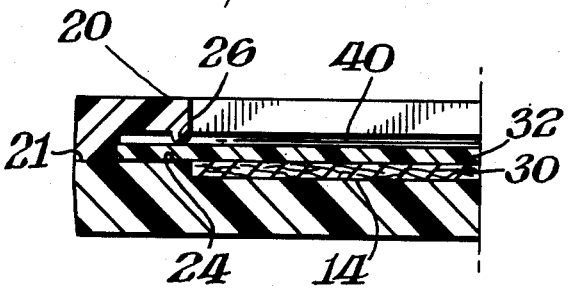
Figure 7:
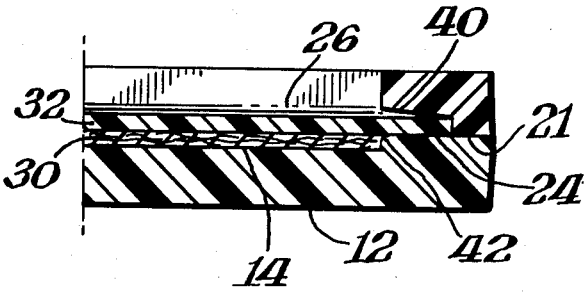
Figure 8:
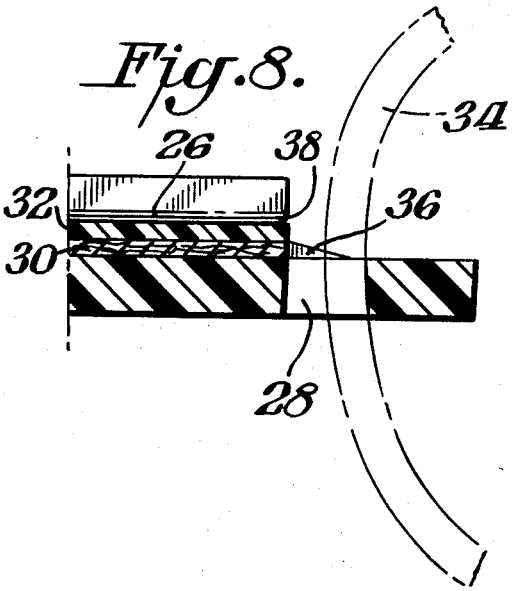

FIGS. 4 and 5 are end elevation views of the identification card holder shown in FIGS. 1–3; and FIGS. 6–8 are cross-sectional views taken through FIG. 1 along the lines 6—6, 7—7 and 8—8.

DETAILED DESCRIPTION

FIGS. 1–8 illustrate a card holder 10 in accordance with this invention. FIGS. 1–5 are drawn to full scale and thus illustrate the relative size and proportion of the components of card holder 10. As shown therein, card holder 10 comprises a one-piece injection molded body member 12 which includes a flat base 14 and an integral upstanding inverted L-shaped flange 16 having a vertical leg 18 and a horizontal leg 20 to create a narrow three-sided frame above the base with a slot 22 being formed between the frame and the base. The fourth side of the frame is open to provide access to the slot.

The open fourth side of the frame functions not only from a slot access standpoint but also enables the part to be tooled for producing body member 12 by the injection molding process since the inclusion of a fourth side would have otherwise rendered the product difficult if not impossible to tool.

As best shown in FIGS. 6–7, a ledge 24 is integrally formed on base 14 of a size and dimension which correspond to and parallels horizontal leg 20. The resultant three-sided ledge thereby creates an open face three-sided pocket for purposes later described. As also shown in FIG. 6, horizontal leg 20 of the frame or flange 16 includes a downwardly extending peripheral bead 26 which projects toward ledge 24. An elongated slot 28 is also provided in base member 12 at the open face of frame 16.

During manufacture, body member 12 is formed by injection molding from two parts which are integrally joined together along mold line 21.

In use an identification card 30 would be inserted into the open face pocket created by ledge 25. This could be done by simply placing the card 30 directly downward into the pocket from the open space of frame 16 of by sliding the card on the base member 12 into the pocket.

After card 30 has been inserted into the open face pocket, a transparent shield 32 is then slid into slot 22. Ledge 24 and bead 26 are so dimensioned that the distance therebetween is such to firmly hold shield 32 in place. For example, the distance may be slightly less than the thickness of shield 32 while the resiliency of frame 16 would permit bead 26 to be urged upward a sufficient distance to accommodate shield 32.

By locating shield 32 in slot 22 card 30 is locked within the open face pocket formed by ledge 24. Because shield 32 is transparent, the identification indicia on card 30 would be clearly visible. As can be appreciated, it is not necessary that card 30 be precisely dimensioned to fit snugly within the open face pocket as long as it is a size that can be inserted into the pocket. The dimensions, however, are preferably selected to accommodate conventional business cards.

After shield 32 has been mounted in place, a strap 34 of any suitable form is inserted through opening or slot 28. Strap 34 in combination with slot 28 serves a dual function. One function is to provide a means for attaching card holder 10 to an item of luggage or the like. The other function is to lock the card 30 and shield 32 in the plastic molded holder 10 under normal conditions of use.

In order to facilitate the insertion of shield 32 into slot 22 various guide surfaces are provided. These guides surfaces include a pair of tapered leading faces 36 for ledge 24 as best shown in FIGS. 1 and 8. Tapered faces 36 act as cam surfaces to guide shield 32 upwardly onto ledge 24 as shield 32 is being inserted into slot 20. In addition, the rounded surface of bead 26 also acts as a guide surface for shield 32. Bead 26 has the additional advantage of providing strength to the steel core used in tooling for the injection molding process by providing a stepping back of the section inside the slot. Otherwise the core would be too weak to withstand the extreme pressures of the injection molded process. As shown in FIG. 8, the lead face 38 of bead 26 is also rounded to function as a guide surface. In addition, as shown in FIG. 7, frame 16 includes a tapered surface 40, and ledge 24 includes a rounded edge 42 which further function as guide surfaces for card 32.

By forming the card holder 10 from the injection molding process it is also possible to incorporate other features in the card holder. For example, the mold may include an interchangeable insert for the back surface of base member 12. Lines 44 in FIG. 3 indicate the outer bounderies of the insert. In this area, indicia may be formed for advertising or other purposes. Such indicia may be either flat to provide a planar appearance to the card holder or may be three dimensional to further highlight the indicia. The insert feature in the mold is particularly desirable since it permits the production of a custom product for various individual customers while still utilizing the same basic tooling.

What is claimed is:

1. An identification card holder comprising a one-piece molded body member, said body member including a flat base, an integral upstanding inverted L-shaped flange extending along the periphery of three sides of said base, said inverted L-shaped flange including a vertical leg integral with said base and a horizontal leg extending over and generally parallel to said base, said L-shaped flange forming a narrow-three-sided frame above said base with a slot formed between said horizontal leg and said base, the fourth side of said frame being open to provide access to said slot, the area between the three sides of said frame being open with the major part of said base being visible, a transparent shield inserted in said slot through said open side of said frame, said inverted L-shaped flange preventing said shield from being freely removed from said slot except through said open side of said frame whereby an identification card may be inserted against said base and the identification card will be held in place by said shield when the identification card is disposed between said base and said shield with the identification card being visible through said shield, said body member including locking means for preventing said shield from being readily removed from said open side of said frame, means for attaching said holder to another object, said locking means and said attaching means comprising the same elements, said elements comprising an opening formed in said base member located at said open side of said frame and a securing strap disposed in said opening, a downwardly extending bead located at the periphery of said horizontal leg and in pressure contact with said shield, a ledge on said base and integral therewith, said ledge being located parallel to said horizontal leg to form a three sided open face pocket on said base for receiving an identification card therein, and said shield resting on said ledge with said bead pressing thereagainst, guide surfaces in said slot to guide said shield as it is being inserted to its intended position, said guide surfaces including tapered surfaces at the lead edge of said ledge, a tapered surface at the remote end of said frame, rounded surfaces at the lead edge of said bead, and rounded surfaces on said ledge disposed beneath said tapered surfaces of said frame.

2. The card holder of claim 1 including indicia integrally formed on the back surface of the base.

3. The card holder of claim 2 wherein said indicia is three dimensional.

* * * * *